US008136207B2

(12) United States Patent
Ambrose

(10) Patent No.: US 8,136,207 B2
(45) Date of Patent: Mar. 20, 2012

(54) PIVOT PIN WITH GRIPPER FEATURE

(76) Inventor: Joseph V. Ambrose, Bradenton, FL (US)

( * ) Notice: Subject to any disclaimer, the term of this patent is extended or adjusted under 35 U.S.C. 154(b) by 601 days.

(21) Appl. No.: 12/269,150

(22) Filed: Nov. 12, 2008

(65) Prior Publication Data

US 2009/0126156 A1 May 21, 2009

Related U.S. Application Data

(60) Provisional application No. 60/988,632, filed on Nov. 16, 2007.

(51) Int. Cl.
*E05D 5/10* (2006.01)

(52) U.S. Cl. ..... 16/386; 16/75; 16/277; 16/285; 16/309; 16/360; 49/386

(58) Field of Classification Search ..... 16/75, 277, 16/285, 309, 354, 360, 386; 49/162, 166, 49/324, 333, 386; 119/481, 482, 494, 501, 119/844
See application file for complete search history.

(56) References Cited

U.S. PATENT DOCUMENTS

| | | | | | |
|---|---|---|---|---|---|
| 244,539 | A | * | 7/1881 | Boyden et al. | 16/285 |
| 580,373 | A | * | 4/1897 | Chandler | 16/285 |
| 777,673 | A | * | 12/1904 | Halin | 16/285 |
| 787,699 | A | * | 4/1905 | Rosentreter | 16/285 |
| 831,236 | A | * | 9/1906 | Ocumpaugh | 16/285 |
| 975,130 | A | * | 11/1910 | Halin | 16/285 |
| 1,429,416 | A | * | 9/1922 | Fade | 16/330 |
| 1,583,842 | A | * | 5/1926 | Keene | 16/285 |
| 3,328,832 | A | * | 7/1967 | Simpson et al. | 16/249 |
| 4,106,158 | A | * | 8/1978 | Kellems et al. | 16/238 |
| 5,158,503 | A | * | 10/1992 | Mitchell | 16/278 |
| 6,418,590 | B1 | * | 7/2002 | Nipper et al. | 16/382 |
| 7,120,967 | B2 | | 10/2006 | Johnson | |

FOREIGN PATENT DOCUMENTS

| | | |
|---|---|---|
| DE | 10 2005 029 625 | 12/2006 |
| FR | 1.016.363 | 11/1952 |
| GB | 1014354 | 12/1965 |

OTHER PUBLICATIONS

International Search Report and Written Opinion for Application No. PCT/US2008/083157, dated Jan. 28, 2009.

* cited by examiner

*Primary Examiner* — Victor Batson
*Assistant Examiner* — Roberta Delisle
(74) *Attorney, Agent, or Firm* — Marshall, Gerstein & Borun LLP

(57) ABSTRACT

A swinging door hinge has a panel and a frame. The frame includes a horizontal portion, and the horizontal portion has an aperture therethrough. An elongated pivot pin is vertically disposed through the aperture. The pivot pin is coupled to the panel such that the pivot pin and the panel rotate about a longitudinal axis of the pivot pin relative to the horizontal portion of the frame. A gripper feature is located on a surface of the pivot pin. The gripper feature engages a corresponding surface on the panel such that when the panel is rotated, a resulting torsional force transferred to the pivot pin is spread over contact area between the gripper feature and the surface of the panel. Because the torque is transferred over a greater area, stress concentrations in the panel are reduced and the panel is not deformed.

18 Claims, 4 Drawing Sheets

PIVOT PIN WITH GRIPPER FEATURE

CROSS REFERENCE TO RELATED APPLICATIONS

The priority benefit of U.S. Provisional Application No. 60/988,632 filed Nov. 16, 2007 is claimed, and the entire contents thereof are expressly incorporated herein by reference.

FIELD OF THE INVENTION

The disclosure relates generally to pivot pins for swinging doors and specifically to pivot pins for swinging pet doors.

BACKGROUND OF THE INVENTION

Pets are an integral part of many families. Dogs and cats are by far the most popular types of pets. Dogs and cats, like all animals, occasionally require access to the outdoors for exercise or to perform other biological functions. Traditionally, owners of pets opened a full size door each time the pet wanted to go outdoors and walked the pet on a leash. Eventually, some owners began fencing a portion of land so that the pet would be free to run within a confined space. Some owners found it convenient to leave the pet in the fenced in portion for most of the day, thereby avoiding repeated opening and closing of the outside door. However, in most climates, temperature variations from day to day could present a hazardous situation for a pet left outdoors.

In order to provide as much freedom as possible while still allowing the pet access into the regulated environment of the home, some pet owners installed small "doggy doors," which the pet could open and close on their own. Most of the early "doggy doors" were simply openings in a wall covered with a flexible material that would give way when the pet passed through the opening. While accomplishing the function of giving the pet access in and out of the home, these early "doggy doors" did not seal well and thus were very energy inefficient. One solution to this problem was mounting a solid swinging door in the opening. Such a door is shown in FIG. 1. The door 10 includes a frame 12 surrounding an opening 14 in a wall of a home. One or more panels 16 are pivotably mounted within the frame 12. The panels 16 may swing in one or both directions and the panels 16 may be biased to a closed position by one or more springs (not shown). The solid panels provide better insulation and a more aesthetically pleasing appearance than the former flexible material doors.

Traditionally, such doors 10 were mounted in the frame 12 with a pivot pin 20 (FIGS. 2A-2B). The pivot pin 20 both located the panel 16 within the frame and provided a drive force (through a spring) to return the panel 16 to the closed position. A pivot pin having a square cross-section both locates the panel 16 and drives the panel 16 to a closed position by applying a force from a spring (not shown) to the panel 16 at one or more contact points 22. Other shapes of pivot pins 20 (FIGS. 2C-2D) may also provide contact points 22 to transfer the closing force from the spring to the panel 16.

The panels 16 are typically made of acrylic or other moldable materials, such as plastic. The contact points 22 (FIG. 2A) focus the drive force of the spring into a very small area of the panel 16. As a result, most prior art panels 16 eventually fail in the vicinity of the contact points 22 due to the repeated focused force from a pet pushing open the panel 16. Often, the pet will impact the panel 16 at full speed, thus producing an initial force that may be much greater than the spring force, causing even more stress within the panel 16 and damaging the pivot pin 20. Replacement of the damaged panel 16 or pivot pin 20 is expensive, time consuming, and physically difficult.

SUMMARY OF THE INVENTION

The present disclosure is directed to a swinging door hinge having a panel and a frame, the frame having a horizontal portion, and the horizontal portion having an aperture therethrough. An elongated pivot pin is vertically disposed through the aperture, the pivot pin being coupled to the panel such that the pivot pin and the panel rotate about a longitudinal axis of the pivot pin relative to the horizontal portion of the frame. A gripper feature is located on a surface of the pivot pin. The gripper feature engages a corresponding surface on the panel such that when the panel is rotated, a resulting torsional force transferred to the pivot pin is spread over a contact area between the gripper feature and the surface of the panel. Because the torque is transferred over a greater area, stress concentrations in the panel are reduced and the panel is not deformed.

Additionally, in one embodiment, the swinging door hinge can comprise a well defined in the panel, the well receiving a portion of the pivot pin adjacent the gripper feature.

In another embodiment, the gripper feature can be located on a bottom surface of the pivot pin.

In an alternative embodiment, the gripper feature can comprise one of a plurality of teeth, a plurality of teeth arranged in a spoked knurl configuration, an external tooth lock washer fixed to the pivot pin, or an adhesive material.

In another embodiment, the swinging door hinge can comprise a torsional spring having two spring arms, the torsional spring being coaxially disposed around the pivot pin and coupled to the panel and the frame, wherein the torsional spring biases the panel into a position that is parallel to a longitudinal axis of the horizontal portion of the frame.

In one embodiment, the bottom surface of the pivot pin can be substantially horizontal.

In another embodiment, the surface of the panel engaged by the pivot pin can be horizontal and disposed within the well formed on the panel.

In a further embodiment, the well can have at least one planar surface disposed substantially normal to the horizontal panel surface engaged by the gripper feature.

In an alternative embodiment, the pivot pin can have at least one vertical surface substantially parallel to the longitudinal axis of the pivot pin that mates with the planar surface of the well to prevent the pivot pin from rotating relative to the well.

In another embodiment, the swinging door hinge has a panel and a frame, the frame having a horizontal portion, and the horizontal portion having an aperture therethrough. An elongated pivot pin is vertically disposed through the aperture, the pivot pin being coupled to the panel such that the pivot pin and the panel rotate about a longitudinal axis of the pivot pin relative to the horizontal portion of the frame. A gripper feature is located on a surface of the pivot pin. The gripper feature engages a corresponding surface on the panel such that when the panel is rotated, a resulting torsional force transferred to the pivot pin is spread over a contact area between the gripper feature and the surface of the panel. A torsional spring having two spring arms is coaxially disposed around the pivot pin and coupled to the panel and the frame, wherein the torsional spring biases the panel into a position that is parallel to a longitudinal axis of the horizontal portion of the frame.

In an alternative embodiment, the swinging door hinge can comprise a bent arm fixed to the pivot pin, the bent arm being positioned between the spring arms such that when the panel and the pivot pin and the bent arm coupled thereto are pivoted about the longitudinal axis of the pivot pin, one arm of the torsional spring acts upon the bent arm to oppose the rotation.

In a further embodiment, the swinging door hinge can comprise a vertical plate coupled to a vertical portion of the frame, the vertical plate being vertically aligned with, and offset to, the longitudinal axis of the pivot pin, the vertical plate also being disposed between the spring arms of the torsion spring such that the vertical plate opposes rotation of the torsional spring relative to the frame.

In a further embodiment, the swinging door hinge has a panel and a frame, the frame having a horizontal portion, and the horizontal portion having an aperture therethrough. An elongated pivot pin is vertically disposed through the aperture, the pivot pin being coupled to the panel such that the pivot pin and the panel rotate about a longitudinal axis of the pivot pin relative to the horizontal portion of the frame. A well is defined in the panel, the well having a horizontal well surface, wherein the well receives a portion of the pivot pin. Additionally, a plurality of teeth are disposed on a bottom surface of the pivot pin, the plurality of teeth engaging the horizontal well surface such that when the panel is rotated, a resulting torsional force transferred to the pivot pin is spread over a contact area between the plurality of teeth and the horizontal well surface. A torsional spring having two spring arms is coaxially disposed around the pivot pin and coupled to the panel and the frame, wherein the torsional spring biases the panel into a position that is parallel to a longitudinal axis of the horizontal portion of the frame.

Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF THE INVENTION

Figure 1:
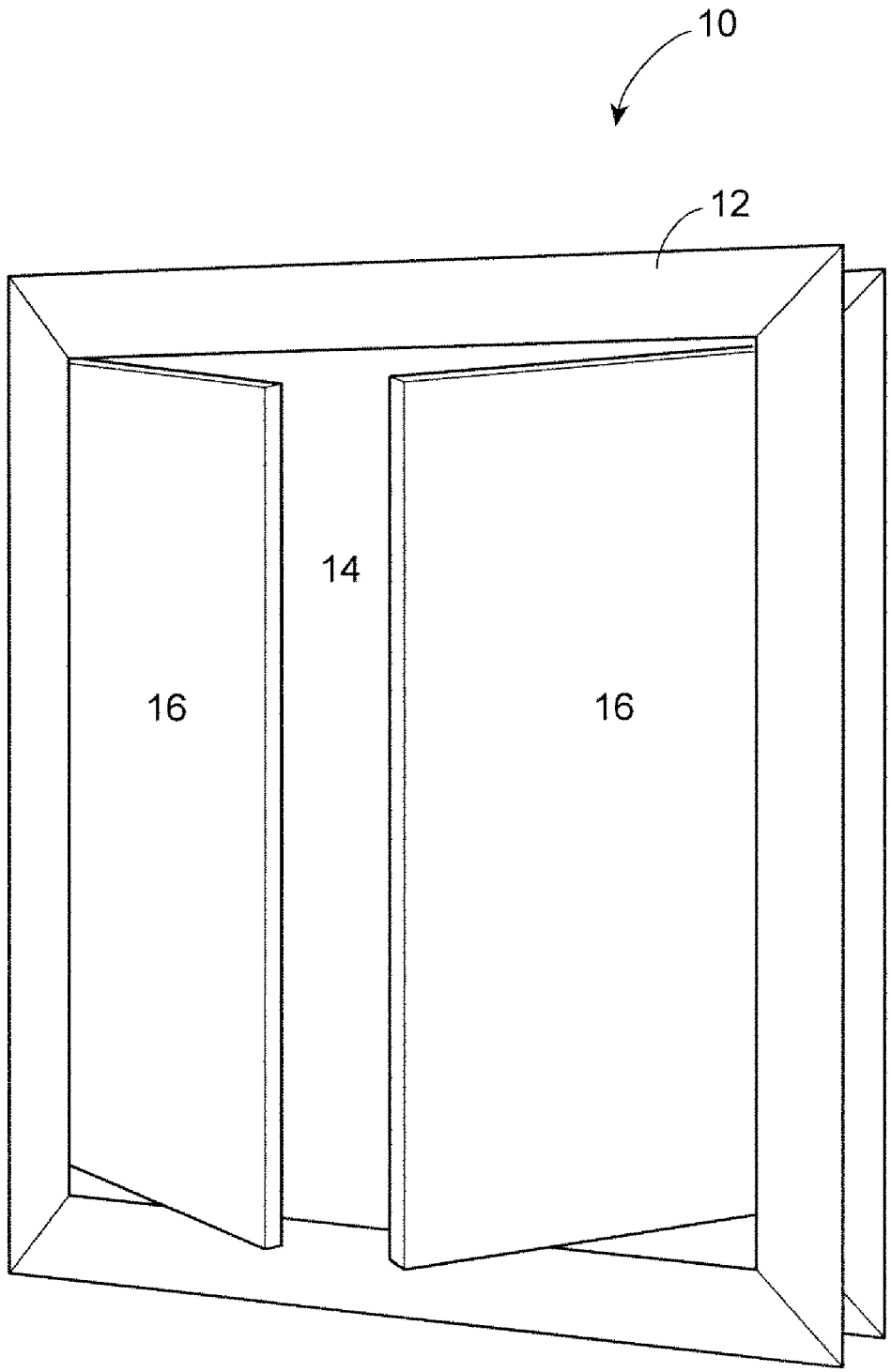
FIG. 1 PRIOR ART
FIG. 1 is a perspective view of a pet door.
Figure 2A:
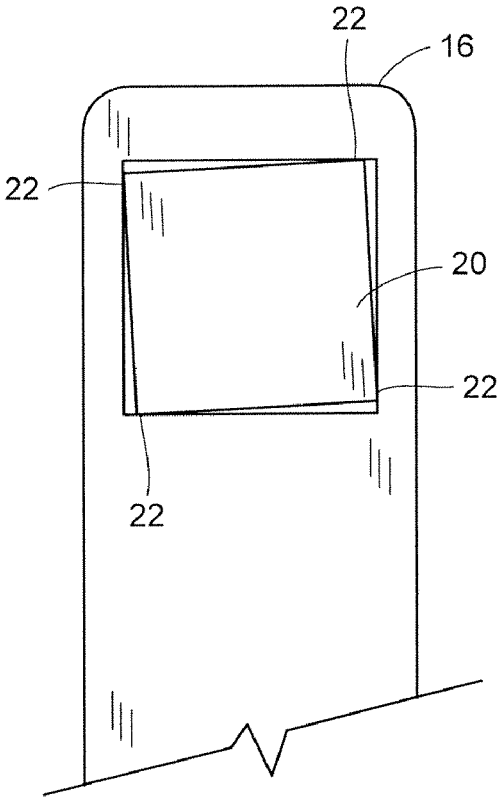
FIG. 2A PRIOR ART
FIG. 2A is a cross-sectional view of a prior art pivot pin installed within the pet door of FIG. 1.
Figure 2B:
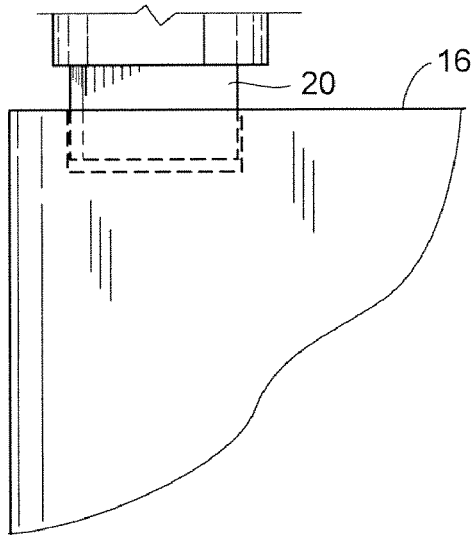
FIG. 2B PRIOR ART
FIG. 2B is a side view of the prior art pivot pin and pet door of FIG. 2A.
Figure 2C:
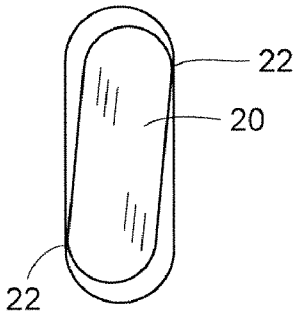
FIG. 2C PRIOR ART
FIG. 2C is a cross-sectional view of a second prior art pivot pin installed within a pet door.
Figure 2D:
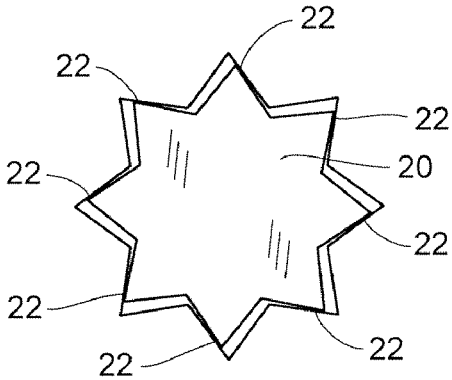
FIG. 2D PRIOR ART
FIG. 2D is a cross-sectional view of a third prior art pivot pin installed within a pet door.
Figure 3A:
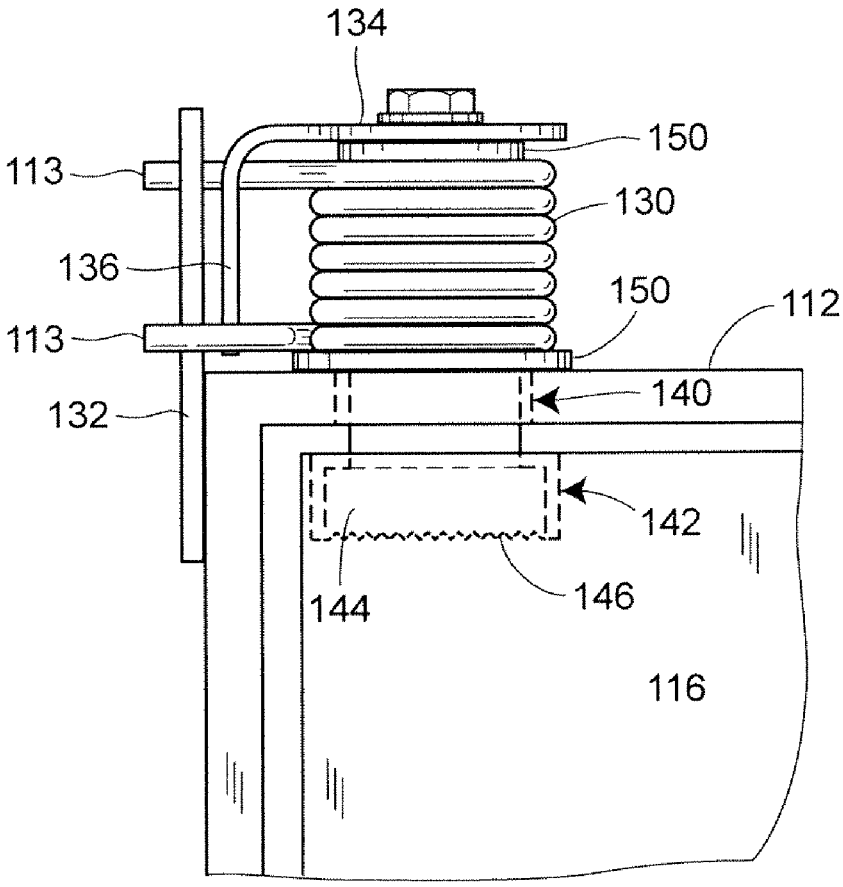
FIG. 3A is a side view of a pet door system constructed in accordance with the teachings of the present disclosure.
Figure 3B:
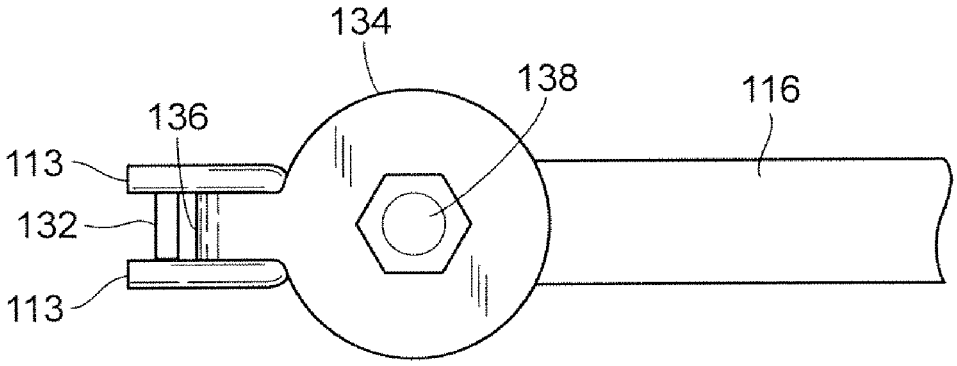
FIG. 3B is a top view of the system of FIG. 3A.

Turning now to FIG. 3A, a pivot pin 120 is shown mounted in a panel 116 of a pet door, for example. The pivot pin 120 centrally locates a torsional spring 130, the ends 113 of which are restrained by a vertical plate 132 that is mounted to a vertical portion of a frame 112. A bent arm 134 is attached to the end of the pivot pin 120 by a fastener 138. The bent arm 134 axially retains the spring 130 and provides a lever arm 136 that is centered between the ends 113 of the spring 130 and transforms angular displacement of the panel 116 to spring energy. The spring energy is then used to close the panel 116 in either direction after a pet exits the opening. The pivot pin 120, the spring 130, and the bent arm 134 are fastened to the panel 116 by the fastener 138 in a manner that will be described. The pivot pin 120 extends through an aperture 140 on a horizontal portion of the frame 112 and into a well 142 in the panel 116. The well 142 of this embodiment has a greater diameter than the aperture 140. The pivot pin 120 is substantially cylindrical and includes a flange 144 disposed within the well 142. The flange 144 stabilizes the pivot pin 120 within the well 142 and aids in assembly. One or more washers 150 may be included to facilitate relative movement between the panel 116 and the frame 112.

Additionally, the pivot pin 120 has a substantially horizontal surface at the bottom end of the pivot pin 120 adjacent the flange 144. A gripper feature 146, such as a plurality of teeth, is formed on or attached to the horizontal surface such that the gripper feature 146 frictionally and continuously engages the substantially horizontal surface defining the bottom of the well 142. The gripper feature 146 distributes the torque that is transferred to the pivot pin 120 by the rotating panel 116 over the contact area of the gripper feature 146 and the bottom surface of the well 142. Because the torque is transferred over a greater area, stress concentrations in the well 142 are reduced and the well 142 exhibits good resistance to deformation.

Figure 4A:
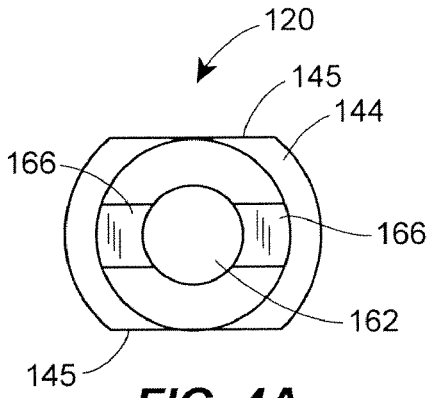
FIGS. 4A-4D are several views of the pivot pin of FIGS. 3A and 3B.
Figure 4B:
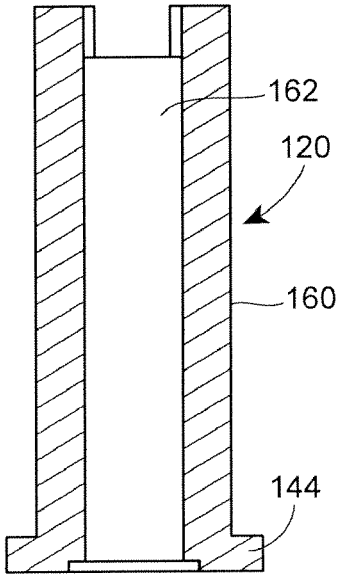
Figure 4C:
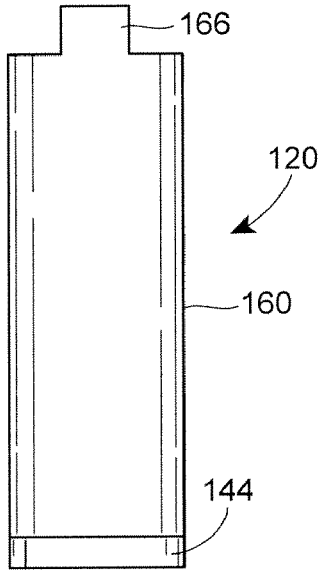
Figure 4D:
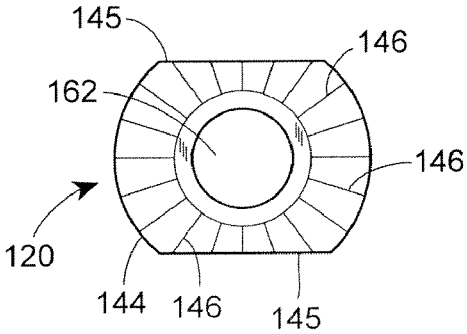

The gripper feature 146 may take virtually any form that allows the pivot pin 120 to mate with the bottom of the well 142. As previously mentioned, the gripper feature 146 may take the form of teeth, either formed integrally with the pivot pin 120 or separately formed and attached to the pivot pin 120. The gripper feature 146 may include a plurality of teeth arrayed in a pattern, such as a spoked knurl configuration (shown in FIG. 4D), for example. The gripper feature 146 may also take the form of an external tooth lock washer attached to the pivot pin 120. The gripper feature 146 may even be formed by a single shape that is extruded over an area on a surface of the pivot pin 120. Alternatively, the gripper feature 146 can include an adhesive material that bonds the pivot pin 120 to one or more interior walls of the well 142, thus providing a virtually infinite number of contact points.

FIGS. 4A-4D show the pivot pin 120 in further detail. The pivot pin 120 has a generally cylindrical body 160 and a central bore 162. The fastener 138 extends through the central bore 162 and engages the body of the panel 116 (shown in FIG. 3A). At one end of the pivot pin 120 is the flange 144 that extends outward, away from the generally cylindrical body 160. The flange 144 includes two flat portions 145 that are used to align the flange 144, and thus the pivot pin 120, along a longitudinal axis of the panel 116. The flange 144 is sized and shaped to be received in the well 142 (FIG. 3A). The well 142 also has two flat sections (not shown) that are arranged substantially parallel to a front and rear face of the panel 116, and which correspond to the flat portions 145 of the pivot pin 120 when the pivot pin 120 is assembled therewith. At an end opposite the flange 144, the pivot pin 120 includes a pair of posts 166. The posts 166 key into mating openings (not shown) in the bent arm 134, thus aligning the lever arm 136 with the center of the longitudinal axis of the panel 116 for transmitting torque from and to the spring 130. This pivot pin 120 arrangement allows rapid and precise positioning of the lever arm 136 with respect to the panel 116, thereby minimizing the time and effort required to assemble the system.

One advantage to this arrangement is that the drive function of the pivot pin 120 is separated from the alignment function of the pivot pin 120. As discussed above, the pivot pin 120 aligns the panel 116 within the frame 112. The pivot pin 120 also acts as a hinge around which the panel 116 pivots. Additionally, the pivot pin 120 is a force transferring member that transmits the spring force in the spring 130 to the panel 116 to return the panel to a closed position. In prior art arrangements, where the alignment function and the drive function were combined (i.e., the square, star, or oblong pivot pins shown in FIGS. 2A-2D), the impact of the pivot pin 120 in the well 142 due to the drive function eventually distorted the well 142, making replacement or realignment difficult. With the disclosed arrangement, the alignment function of the pivot pin 120 remains unaffected by the drive function of the pivot pin 120. The drive force from the spring 130 is transmitted through the bottom of the pivot pin 130 by the gripper feature 146 to the panel 116.

As a result of spreading the driving force across a larger area (through the gripper feature 146 and the larger surface area of the bottom of the flange 144), there is much less stress transferred to the panel 116 and thus less material failure. For example, a spring that produces 8 ft lbs of torque on a pivot pin that has 8 contact points (i.e., the star shaped pivot pin of FIG. 2D) results in each contact point carrying 1 ft lb of torque. On the other hand, a pivot pin that has 200 contact points (i.e., a plurality of teeth) results in each contact point carrying approximately 0.04 ft lbs of torque.

Additionally, final assembly time for the pet door is reduced approximately 40% because of the precise alignment between the pivot pin 120 and the lever arm 136. Moreover, replacement of parts (such as the spring 130) is quicker and more precise. The panel 116 and pivot pin 120 can be disassembled and reassembled many times without damaging the well 142.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

While particular embodiments of the present invention have been illustrated and described, various changes and modifications can be made without departing from the spirit and scope of the invention, which is defined by the following claims.

I claim:

1. A swinging door assembly, comprising:

a panel;

a frame having a horizontal portion, the horizontal portion having an aperture therethrough;

an elongated pivot pin vertically disposed through the aperture, the pivot pin being coupled to the panel such that the pivot pin and the panel rotate about a longitudinal axis of the pivot pin relative to the horizontal portion of the frame;

a gripper feature located on a surface of the pivot pin, the gripper feature engages a corresponding surface on the panel such that when the panel is rotated, a resulting torsional force transferred to the pivot pin is spread over a contact area between the gripper feature and the surface on the panel;

a torsional spring having two spring arms, the torsional spring being coaxially disposed around the pivot pin, wherein the torsional spring biases the panel into a position that is parallel to a longitudinal axis of the horizontal portion of the frame; and a bent arm fixed to the pivot pin, the bent arm being positioned between the spring arms such that when the panel and the pivot pin and the bent arm coupled thereto are pivoted about the longitudinal axis of the pivot pin, one arm of the torsional spring acts upon the bent arm to oppose the rotation.

2. The swinging door assembly of claim 1, further comprising a vertical plate coupled to a vertical portion of the frame, the vertical plate being vertically aligned with, and offset to, the longitudinal axis of the pivot pin, the vertical plate also being disposed between the spring arms of the torsion spring such that the vertical plate opposes rotation of the torsional spring relative to the frame.

3. The swinging door assembly of claim 1, wherein the gripper feature comprises one of a plurality of teeth, a plurality of teeth arranged in a spoked knurl configuration, an external tooth lock washer fixed to the pivot pin, or an adhesive material.

4. The swinging door assembly of claim 1, further comprising a well defined in the panel, the well receiving a portion of the pivot pin adjacent the gripper feature.

5. The swinging door assembly of claim 4, wherein the gripper feature is located on a bottom surface of the pivot pin.

6. The swinging door assembly of claim 5, wherein the bottom surface of the pivot pin is substantially horizontal.

7. The swinging door assembly of claim 6, wherein the surface of the panel engaged by the pivot pin is horizontal and disposed within the well formed on the panel.

8. The swinging door assembly of claim 7, wherein the well has at least one planar surface disposed substantially normal to the horizontal panel surface engaged by the gripper feature.

9. The swinging door assembly of claim 8, wherein the pivot pin has at least one vertical surface substantially parallel to the longitudinal axis of the pivot pin that mates with the planar surface of the well to prevent the pivot pin from rotating relative to the well.

10. A swinging door assembly, comprising:

a panel;

a frame having a horizontal portion, the horizontal portion having an aperture therethrough;

an elongated pivot pin vertically disposed through the aperture, the pivot pin being coupled to the panel such that the pivot pin and the panel rotate about a longitudinal axis of the pivot pin relative to the horizontal portion of the frame;

a gripper feature located on a surface of the pivot pin, the gripper feature engages a corresponding surface on the panel such that when the panel is rotated, a resulting torsional force transferred to the pivot pin is spread over a contact area between the gripper feature and the surface on the panel;

a torsional spring having two spring arms, the torsional spring being coaxially disposed around the pivot pin, wherein the torsional spring biases the panel into a position that is parallel to a longitudinal axis of the horizontal portion of the frame;

a bent arm fixed to the pivot pin, the bent arm being positioned between the spring arms such that when the panel and the pivot pin and the bent arm coupled thereto are pivoted about the longitudinal axis of the pivot pin, one arm of the torsional spring acts upon the bent arm to oppose the rotation; and a vertical plate coupled to a vertical portion of the frame, the vertical plate being vertically aligned with, and offset to, the longitudinal axis of the pivot pin, the vertical plate also being disposed between the spring arms of the torsion spring such that the vertical plate opposes rotation of the torsional spring relative to the frame.

11. The swinging door assembly of claim 10, wherein the gripper feature comprises one of a plurality of teeth, a plurality of teeth arranged in a spoked knurl configuration, an external tooth lock washer fixed to the pivot pin, or an adhesive material.

12. The swinging door assembly of claim 10, further comprising a well defined in the panel, the well receiving a portion of the pivot pin adjacent the gripper feature.

13. The swinging door assembly of claim 12, wherein the gripper feature is located on a bottom surface of the pivot pin.

14. The swinging door assembly of claim 13, wherein the bottom surface of the pivot pin is substantially horizontal.

15. The swinging door assembly of claim 14, wherein the surface of the panel engaged by the pivot pin is horizontal and disposed within the well formed on the panel.

16. The swinging door assembly of claim 15, wherein the well has at least one planar surface disposed substantially normal to the horizontal panel surface engaged by the gripper feature.

17. The swinging door assembly of claim 16, wherein the pivot pin has at least one vertical surface substantially parallel to the longitudinal axis of the pivot pin that mates with the planar surface of the well to prevent the pivot pin from rotating relative to the well.

18. The swinging door assembly of claim 17, wherein the gripper feature comprises one of a plurality of teeth, a plurality of teeth arranged in a spoked knurl configuration, an external tooth lock washer fixed to the pivot pin, or an adhesive material.

* * * * *